US011108199B2

(12) United States Patent
Lödding et al.

(10) Patent No.: US 11,108,199 B2
(45) Date of Patent: Aug. 31, 2021

(54) COAXIAL CONNECTOR

(71) Applicant: Rosenberger Hochfrequenztechnik GmbH & Co. KG, Fridolfing (DE)

(72) Inventors: Thomas Lödding, Traunstein (DE); Christian Maier, Griesstätt (DE); Gunnar Armbrecht, Mühldorf (DE); Thomas Schmid, Teisendorf (DE)

(73) Assignee: ROSENBERGER HOCHFREQUENZTECHNIK GMBH & CO. KG, Fridolfing (DE)

( * ) Notice: Subject to any disclaimer, the term of this patent is extended or adjusted under 35 U.S.C. 154(b) by 71 days.

(21) Appl. No.: 16/305,079

(22) PCT Filed: Apr. 28, 2017

(86) PCT No.: PCT/EP2017/000528
§ 371 (c)(1),
(2) Date: Nov. 28, 2018

(87) PCT Pub. No.: WO2017/211437
PCT Pub. Date: Dec. 14, 2017

(65) Prior Publication Data

US 2020/0235534 A1 Jul. 23, 2020

(30) Foreign Application Priority Data

Jun. 6, 2016 (DE) ..... 10 2016 006 923.6

(51) Int. Cl.
*H01R 24/52* (2011.01)
*H01R 13/187* (2006.01)
*H01R 13/6582* (2011.01)

(52) U.S. Cl.
CPC ..... *H01R 24/52* (2013.01); *H01R 13/187* (2013.01); *H01R 13/6582* (2013.01); *H01R 2201/02* (2013.01)

(58) Field of Classification Search
CPC ..... H01R 13/187; H01R 13/111; H01R 13/6582; H01R 24/52; H01R 2201/02
(Continued)

(56) References Cited

U.S. PATENT DOCUMENTS 3,439,110 A 4/1969 Lusk
5,167,543 A * 12/1992 Wurster ..... H01R 13/111 439/851
(Continued)

FOREIGN PATENT DOCUMENTS

CN 102870280 A 1/2013
CN 202906019 U 4/2013
(Continued)

OTHER PUBLICATIONS

Machine translation of FR 1.263.085.
Machine translation of JP H6-29046 U (JP 平6-29046 U).

*Primary Examiner* — Gary F Paumen
(74) *Attorney, Agent, or Firm* — David P. Dickerson

(57) ABSTRACT

A coaxial connector has a first coaxial connector portion (1) and a second coaxial connector portion (2). The first coaxial connector portion (1) has an external conductor which is designed as a coaxial socket and the distal end of which is designed as a spring cage (3) with individual spring lugs ($\mathbf{9}_1$, $\mathbf{9}_2$, $\mathbf{9}_3$, $\mathbf{9}_4$, $\mathbf{9}_5$). The second coaxial connector portion (2) has an external conductor (6) which is designed as a coaxial plug. An electrical and mechanical connection exists between the spring lugs ($\mathbf{9}_1$, $\mathbf{9}_2$, $\mathbf{9}_3$, $\mathbf{9}_4$, $\mathbf{9}_5$) of the first coaxial connector portion (1) and an external shell surface of the external conductor (6) of the second coaxial connector portion (2). In the region of each gap ($\mathbf{10}_1$, $\mathbf{10}_2$, $\mathbf{10}_3$, $\mathbf{10}_4$, $\mathbf{10}_5$) that is situated between in each case two adjacent spring lugs ($\mathbf{9}_1$, $\mathbf{9}_2$, $\mathbf{9}_3$, $\mathbf{9}_4$, $\mathbf{9}_5$), there is provided at least one shielding component ($\mathbf{11}_1$, $\mathbf{11}_2$, $\mathbf{11}_3$, $\mathbf{11}_4$, $\mathbf{11}_5$, $\mathbf{11}_1'$, $\mathbf{11}_2'$, $\mathbf{11}_3'$,
(Continued)

$11_4$', $11_5$') which is connected respectively to one of the two adjacent spring lugs ($9_1$, $9_2$, $9_3$, $9_4$, $9_5$). A multiple coaxial connector portion has multiple first coaxial connector portion is arranged in a housing (12).

24 Claims, 7 Drawing Sheets

(58) Field of Classification Search
USPC ..... 439/843, 851
See application file for complete search history.

(56) References Cited

U.S. PATENT DOCUMENTS

| | | | | |
|---|---|---|---|---|
| 5,807,147 | A | 9/1998 | Bickford | |
| 6,126,487 | A | 10/2000 | Rosenberger | |
| 6,638,116 | B2 * | 10/2003 | Byron | H01R 13/18 439/584 |
| 8,142,238 | B2 * | 3/2012 | Heigl | H01R 13/111 439/843 |
| 8,636,529 | B2 * | 1/2014 | Stein | H01R 13/111 439/252 |
| 8,876,562 | B2 * | 11/2014 | Glick | H01R 13/187 439/843 |
| 8,992,270 | B2 * | 3/2015 | Glick | H01R 13/18 439/839 |
| 2002/0076964 | A1 | 6/2002 | Weisz-Margulescu | |

FOREIGN PATENT DOCUMENTS

| | | | |
|---|---|---|---|
| CN | 103682842 | A | 3/2014 |
| DE | 202005004658 | U1 | 7/2005 |
| EP | 2490304 | A2 | 8/2012 |
| FR | 1263085 | A | 6/1961 |
| JP | S49-079787 | U | 7/1974 |
| JP | S56-69872 | U | 6/1981 |
| JP | H6-29046 | U | 4/1994 |
| JP | 2008535152 | A | 8/2008 |
| JP | 2010153082 | A | 7/2010 |

* cited by examiner

COAXIAL CONNECTOR

FIELD OF THE INVENTION

The invention relates to a coaxial connector.

TECHNICAL BACKGROUND

A motor vehicle roof antenna which has multiple antennae, for example a mobile radio antenna and a GPS antenna, has, in its housing, in each case one coaxial connector portion for each antenna, as disclosed in DE 20 2005 004 658 U1. The coaxial connector portions, which will hereinafter be referred to as first coaxial connector portions, are typically arranged parallel and with a certain spacing to one another, and, together with associated coaxial counterpart connector portions, which will hereinafter be referred to a second coaxial connector portions, form in each case one coaxial connector.

The individual coaxial connector portion constitutes the interface between the high-frequency signal line to the associated antenna connection in the housing of the motor vehicle roof antenna and the high-frequency signal line to the associated terminal within the motor vehicle.

The external conductor of a first coaxial connector portion of said type is designed as a so-called spring cage. A spring cage is to be understood to mean a substantially prismatic or sleeve-shaped hollow body which, at the distal end of the external conductor, has in each case one gap of a certain length along the individual side edges—in the case of a prismatic hollow body—or in equidistant angular sections—in the case of a sleeve-shaped hollow body. In each case one spring lug is situated between two gaps.

It is preferable for each spring lug, in the direction of the distal end of the external conductor, that is to say of the distal end of the spring cage, to be both narrowed in width and directed radially inward in the direction of the longitudinal axis of the prismatic or sleeve-shaped hollow body. It is furthermore preferable for the individual spring lugs, at the distal end of the spring cage, to be directed radially outward again in order to more easily center the second coaxial connector portion as the second coaxial connector portion is plugged into the associated first coaxial connector portion.

In particular in the case of a prismatic hollow body being used as a spring cage, the individual spring lugs are each planar. The planarity of the individual spring lugs permits a high level of flexibility at the proximal end of the individual spring lugs.

If a second coaxial connector portion is plugged into a first coaxial connector portion, each individual spring lug of the spring cage belonging to the first coaxial connector portion makes contact, at the transition between its radially inwardly directed region and its radially outwardly directed region, with the outer shell surface of the external conductor of the associated second coaxial connector portion. In the plugged-together state, each individual spring lug of the spring cage is braced and, with its spring force thereby generated, effects firstly a non-positively locking mechanical connection and secondly good electrical contact between the first and second coaxial connector portions.

It is preferable for each individual substantially planar spring lug of the spring cage to have, on the inside in its center, an inwardly directed elevation, a so-called bead, which runs in a longitudinal direction of the spring lug. Said bead additionally increases the stiffness at the distal end of the individual spring lug.

In particular in the plugged-together state of the coaxial connector, the gaps between the individual spring lugs of the spring cage become larger, which disadvantageously do not optimally shield the electromagnetic radiation generated by the second coaxial connector portion.

If multiple first coaxial connector portions and multiple second coaxial connector portions are arranged respectively in parallel in a housing, and if, here, the spacing between individual first coaxial connectors differs from the spacing between associated second coaxial connectors for manufacturing reasons, then the width of individual gaps in the individual spring cages can also additionally become larger and additionally impair the shielding attenuation of the spring cage.

It is therefore an object of the invention to provide a coaxial connector with optimized shielding characteristics.

SUMMARY OF THE INVENTION

This object is addressed by the embodiments recited in the independent claims. Further embodiments are recited in the dependent claims.

According to the invention, in the region of each gap between in each case two adjacent spring lugs of the spring cage, there is provided in each case at least one shielding component which is connected to one of the respectively adjacent spring lugs.

A shielding component is to be understood substantially to mean a component which, owing to its shape, its size, its position and its orientation in relation to the spring lug to which the shielding component is connected, at least partially attenuates, or prevents an emission of, the electromagnetic radiation that is emitted from the coaxial connector through the gap between the two adjacent spring lugs.

In a first preferred embodiment according to the invention, for each gap, there is provided in each case one single shielding component which is fastened to a spring lug and which at least partially covers the gap between the two adjacent spring lugs. The more completely the entire gap between two adjacent spring lugs is covered by the shielding component, the more effective is the shielding of the electromagnetic radiation in the gap and thus the attenuation of the emission of the electromagnetic radiation from the gap.

In an enhancement of the first embodiment according to the invention, the shielding component which is respectively provided for each gap and which is fastened to a spring lug preferably also at least partially covers the spring lug situated at the other end of the gap. Whereas it is the case even with approximately complete coverage of the gap by the shielding component that electromagnetic radiation can escape from the coaxial connector through a residual slot, which is required for functional and manufacturing reasons, between shielding component and opposite spring lug, this is, in the case of the opposite spring lug being covered by the shielding component, prevented to an ever greater degree with increasing coverage of the opposite spring lug.

In a first sub-variant of the first embodiment according to the invention, the shielding component is of planar design. This design of a shielding component advantageously constitutes the easiest shielding in terms of manufacturing.

In a second sub-variant of the first embodiment according to the invention, the shielding component has a bend. By means of the bend, the gap can be more effectively covered by the shielding component. In particular, by means of the bend, the orientation of the two sub-regions of the shielding component can be adapted to the orientation of the respectively adjacent spring lug, and therefore the non-covered residual gap can be minimized.

In a third sub-variant of the first embodiment according to the invention, the shielding component has a curvature which corresponds to the curvature of the individual spring lugs. In comparison with the first sub-variant, the third sub-variant exhibits improved coverage of the gap and thus improved shielding. In general, each shielding component of the first embodiment according to the invention should, with regard to its shape, its size, its position and its orientation in relation to the spring lug to which the shielding component is connected, be designed and parameterized such that, both in the non-plugged-together state and during the plugging-together phase of the first and second coaxial connector portions, no blockage, seizing or jamming occurs between the shielding component and the oppositely situated spring lug which is not connected to the shielding component.

In a second embodiment according to the invention, to both spring lugs that are respectively adjacent to one another across a gap, there is fastened in each case one shielding component.

In a first sub-variant of the second embodiment according to the invention, the two shielding components are fastened respectively to the gap-side ends of the respective spring lugs in a radially outward direction with respect to the longitudinal axis of the coaxial connector, that is to say approximately at a perpendicular angle with respect to the respective spring lug.

In the first sub-variant, the two shielding components are thus oriented approximately parallel, and thus lengthen the associated gap in a radially outward direction with respect to the longitudinal axis of the coaxial connector, so as to form a channel. In this channel-like elongation of the gap in a radial direction, emitted electromagnetic radiation is attenuated to a similar degree as in the case of coverage of the gap by at least one shielding component.

In a second sub-variant of the second embodiment according to the invention, in the plugged-together state, the two shielding components at least partially cover one another. In a third sub-variant of the second embodiment according to the invention, in the plugged-together state of the first and second coaxial connector portions, the two shielding components cover respectively a different region of the common gap.

In order, in the non-plugged-together state and in the phase of the plugging-together of the first and second coaxial connector portions, to prevent blockage, seizing or blockage between the two shielding components of a gap, the two shielding components should be designed suitably with regard to their size, shape, position and orientation with respect to the respective spring lug to which they are respectively fastened.

The first coaxial connector portion according to the invention, together with the second coaxial connector portion, forms a single coaxial connector according to the invention. In addition thereto, multiple first coaxial connector portions are integrated, parallel and with a certain spacing to one another in a respectively spaced-apart manner, in a housing of a multiple coaxial connector portion according to the invention, for example in order for multiple high-frequency signals to be exchanged between multiple antennae respectively integrated in a motor vehicle roof antenna and multiple terminals arranged in the motor vehicle.

For this purpose, associated second coaxial connector portions, as individual coaxial connector portions or integrated in parallel in a housing of a further multiple coaxial connector portion, should be connected to the associated first coaxial connector portions of the multiple coaxial connector portion according to the invention in order to realize in each case one coaxial connector according to the invention.

To produce the first coaxial connector portion according to the invention, the external conductor has to be manufactured in addition to the internal conductor and the insulator. In particular, the manufacturer of the spring cage that forms the external conductor of the first coaxial connector constitutes a method according to the invention.

For this purpose, in a first method step, an electrically conductive planar component, composed preferably of spring bronze ($CuSn_6$) or of some other suitable metal, is punched in accordance with the required axial length and the required circumferential length of the external conductor, which is realized as a coaxial socket or as a spring cage.

From this component, for each gap of the spring cage, the shielding component or the two shielding components are respectively punched out in accordance with their size, their shape and their position with respect to the spring lug to which they are respectively connected.

In the next method step, the punched-out planar component is bent to form a hollow cylindrical component and is connected together at the two shell-side ends in order to realize an external conductor, realized as a coaxial socket or as a spring cage, of the first coaxial connector portion according to the invention.

In the final method step, finally, in the individual gaps of the external conductor realized as a spring cage, the associated shielding component or the associated shielding components are bent into a final shape and into a final orientation with respect to the associated spring lug to which the respective shielding component is fastened.

BRIEF DESCRIPTION OF THE DRAWINGS

The embodiments, enhancements and sub-variants of the coaxial connector according to the invention, of the first coaxial connector portion according to the invention, of the multiple coaxial connector portion according to the invention and of the method according to the invention for manufacturing the spring cage of the first coaxial connector portion according to the invention will be discussed in detail below on the basis of the drawing. In the figures of the drawing.

DETAILED DESCRIPTION

Figure 1A:
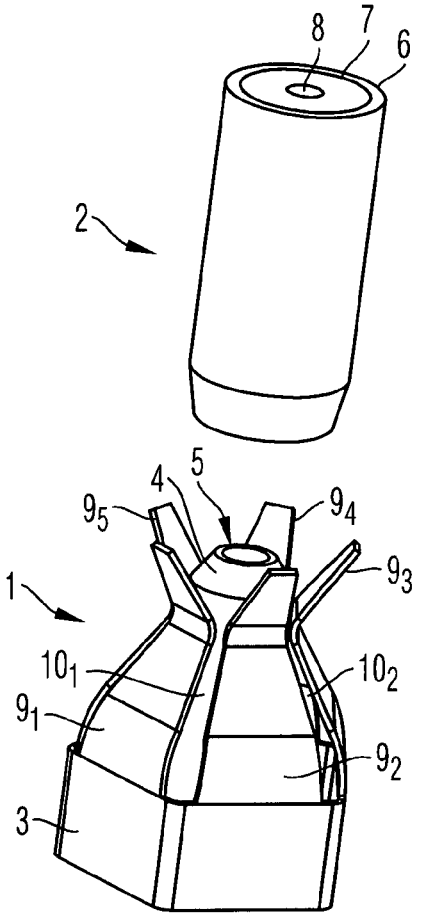
FIGS. 1A, 1B show an illustration of a side view and front view of a coaxial connector in the non-plugged-together state according to the prior art.

Before the coaxial connector according to the invention is discussed in detail, the coaxial connector according to the prior art will firstly be described below, in the non-plugged-together state on the basis of FIGS. 1A and 1B and in the plugged-together state on the basis of FIGS. 2A and 2B:

The coaxial connector is composed of a first coaxial connector portion 1 and a second coaxial connector portion 2.

The first coaxial connector portion 1 has a spring cage 3, which forms the external conductor, a substantially hollow cylindrical insulator part 4, which is situated within the spring cage 3, and a substantially cylindrical internal conductor 5, which is situated within the hollow cylindrical insulator part 4.

The second coaxial connector 2 has a substantially hollow cylindrical external conductor 6, a substantially hollow cylindrical insulator part 7, which is situated within the external conductor 6, and a substantially cylindrical internal conductor 8, which is situated within the insulator part 7.

Figure 1B:
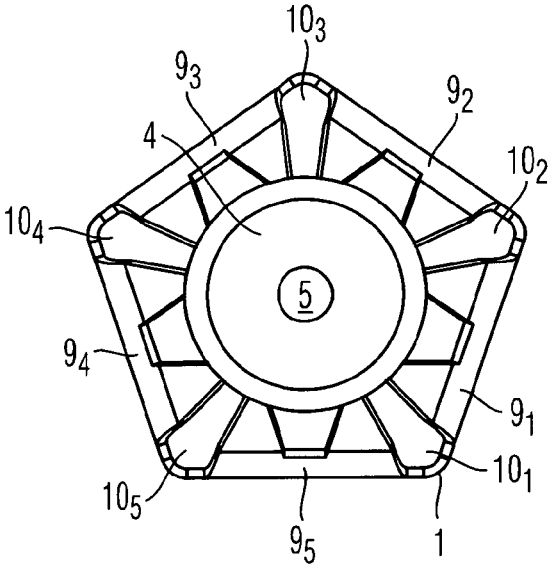

In the three-dimensional side view as per FIGS. 1A and 1*n* the two-dimensional front view as per FIG. 1B, the spring cage 3 has substantially a prismatic hollow body with five edges. Thus, said spring cage 3 has a total of five spring lugs $\mathbf{9}_1$, $\mathbf{9}_2$, $\mathbf{9}_3$, $\mathbf{9}_4$ and $\mathbf{9}_5$, which are separated from one another by in each case one gap $\mathbf{10}_1$, $\mathbf{10}_2$, $\mathbf{10}_3$, $\mathbf{10}_4$ and $\mathbf{10}_5$. The invention however also encompasses a spring cage 3 having a different, technically expedient number of edges and therefore of spring lugs.

Furthermore, each spring lug $\mathbf{9}_1$, $\mathbf{9}_2$, $\mathbf{9}_3$, $\mathbf{9}_4$ and $\mathbf{9}_5$ has in each case one planar surface correspondingly to the prismatic main hollow body. The planar surface of each spring lug $\mathbf{9}_1$, $\mathbf{9}_2$, $\mathbf{9}_3$, $\mathbf{9}_4$ and $\mathbf{9}_5$ narrows in each case with regard to its width toward the distal end of the first coaxial connector portion 1. Furthermore, in the direction of the distal end of the first coaxial connector portion 1, the planar surface of each spring lug is oriented radially inward in a first section and oriented radially outward in an adjoining second section. By means of the radial orientation of the second section of each spring lug $\mathbf{9}_1$, $\mathbf{9}_2$, $\mathbf{9}_3$, $\mathbf{9}_4$ and $\mathbf{9}_5$, the second coaxial connector portion 2 can be more easily centered in the first coaxial connector portion 1 during the plugging-together process.

Figure 2A:
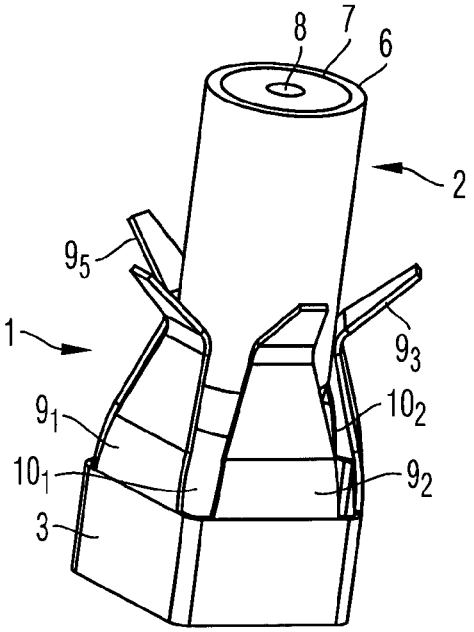
FIGS. 2A, 2B show an illustration of a side view and front view of a coaxial connector in the plugged-together state according to the prior art.
Figure 2B:
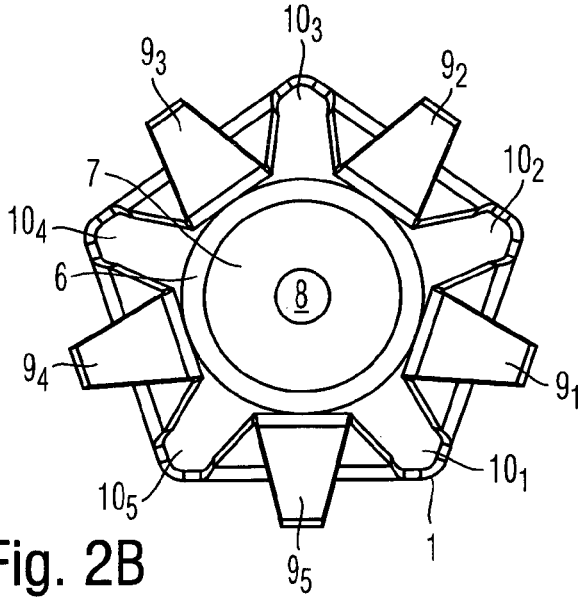

In the plugged-together state of the coaxial connector as can be seen from FIGS. 2A and 2B, within the transition region between the radially inwardly directed first section and the radially outwardly directed second section of each spring lug $\mathbf{9}_1$, $\mathbf{9}_2$, $\mathbf{9}_3$, $\mathbf{9}_4$ and $\mathbf{9}_5$, there is in each case substantially punctiform electrical contact with the external conductor 6 of the second coaxial connector 2.

Each spring lug $\mathbf{9}_1$, $\mathbf{9}_2$, $\mathbf{9}_3$, $\mathbf{9}_4$ and $\mathbf{9}_5$ has, on its inner side, in each case one elevation—a so-called bead—which is in each case not illustrated in FIGS. 1A, 1B, 2A and 2B and which runs centrally in the direction of the longitudinal axis of the coaxial connector.

Proceeding from the distal end of the coaxial connector, said bead extends not over the full length of the spring lug $\mathbf{9}_1$, $\mathbf{9}_2$, $\mathbf{9}_3$, $\mathbf{9}_4$ and $\mathbf{9}_5$. In that region of the respective spring lug $\mathbf{9}_1$, $\mathbf{9}_2$, $\mathbf{9}_3$, $\mathbf{9}_4$ and $\mathbf{9}_5$ in which a bead runs, the respective spring lug $\mathbf{9}_1$, $\mathbf{9}_2$, $\mathbf{9}_3$, $\mathbf{9}_4$ and $\mathbf{9}_5$ exhibits high stability in each case, whereas, in that region of the respective spring lug $\mathbf{9}_1$, $\mathbf{9}_2$, $\mathbf{9}_3$, $\mathbf{9}_4$ and $\mathbf{9}_5$ in which the bead is omitted, the respective spring lug $\mathbf{9}_1$, $\mathbf{9}_2$, $\mathbf{9}_3$, $\mathbf{9}_4$ and $\mathbf{9}_5$ exhibits high flexibility in each case.

The comparison of FIGS. 1B and 2B shows that the gaps $\mathbf{10}_1$, $\mathbf{10}_2$, $\mathbf{10}_3$, $\mathbf{10}_4$ and $\mathbf{10}_5$ between the individual spring lugs $\mathbf{9}_1$, $\mathbf{9}_2$, $\mathbf{9}_3$, $\mathbf{9}_4$ and $\mathbf{9}_5$ are smaller in the non-plugged-together state of the coaxial plug connector than in the plugged-together state, and thus disadvantageously release a considerably greater amount of electromagnetic radiation and thus a considerably greater amount of electromagnetic signal energy from the coaxial connector.

To reduce the radiation of electromagnetic signal energy through the gaps $\mathbf{10}_1$, $\mathbf{10}_2$, $\mathbf{10}_3$, $\mathbf{10}_4$ and $\mathbf{10}_5$ between the individual spring lugs $\mathbf{9}_1$, $\mathbf{9}_2$, $\mathbf{9}_3$, $\mathbf{9}_4$ and $\mathbf{9}_5$, shielding components $\mathbf{11}_1$, $\mathbf{11}_2$, $\mathbf{11}_3$, $\mathbf{11}_4$ and $\mathbf{11}_5$ are respectively provided in the individual gaps $\mathbf{10}_1$, $\mathbf{10}_2$, $\mathbf{10}_3$, $\mathbf{10}_4$ and $\mathbf{10}_5$.

As known in the art, radiation of electromagnetic signal energy typically travels along straight line paths known as rays.

As shown in the figures, spring lugs $\mathbf{9}_1$, $\mathbf{9}_2$, $\mathbf{9}_3$, $\mathbf{9}_4$, $\mathbf{9}_5$ may constitute tab-like structures. As likewise shown in the figures, a tab may comprise at least one shielding portion in the form a respective shielding component $\mathbf{11}_1$, $\mathbf{11}_2$, $\mathbf{11}_3$, $\mathbf{11}_4$, $\mathbf{11}_5$. As shown in the figures and described hereinbelow, the individual shielding components $\mathbf{11}_1$, $\mathbf{11}_2$, $\mathbf{11}_3$, $\mathbf{11}_4$, $\mathbf{11}_5$ may be fastened to a respective tab, namely to a portion of the respective tab that may be designated as a first portion. As shown in the figures and described above, a tab may comprise at least one planar surface. As such, a tab may comprise, for example, a first plane $\mathbf{14}_1$, $\mathbf{14}_2$ defined by a major planar surface, e.g. by a major planar surface of the first portion of the respective tab. Similarly, a tab may comprise a second plane $\mathbf{16}_1$, $\mathbf{16}_2$ defined by a major planar surface, e.g. by a major planar surface of a second portion of the respective tab. A portion of the first/second portion toward the proximal end of the tab may be designated as a proximal portion. A portion of the first/second portion toward the distal end of the tab may be designated as a distal portion.

As shown in the figures and described hereinbelow, a tab may comprise at least one bend. For example, in FIGS. 3A and 5A reference sign 22 identifies a bend along a border of a shielding portion. In the embodiments depicted in FIGS. 3A and 5A, bend 22 may furthermore be described as being intermediate the first portion and the shielding portion of the respective tab. In FIG. 4B reference sign 24 identifies another type of bend, namely a bend situated within the bounds of a shielding component. As depicted, such a bend may divide the shielding component into two regions. Bend 24 may furthermore be described as being intermediate a first region of the shielding portion and a second region of the shielding portion.

In a first embodiment of the invention, in each case one shielding component $\mathbf{11}_1$, $\mathbf{11}_2$, $\mathbf{11}_3$, $\mathbf{11}_4$ and $\mathbf{11}_5$ is provided in each gap $10_1$, $10_2$, $10_3$, $10_4$ and $10_5$. Said shielding component $11_1$, $11_2$, $11_3$, $11_4$ and $11_5$ is respectively fastened to a spring lug $9_1$, $9_2$, $9_3$, $9_4$ and $9_5$, preferably to the gap-side end of the spring lug $9_1$, $9_2$, $9_3$, $9_4$ and $9_5$, which is adjacent to the gap $10_1$, $10_2$, $10_3$, $10_4$ and $10_5$ that is to be shielded.

Figure 3A:
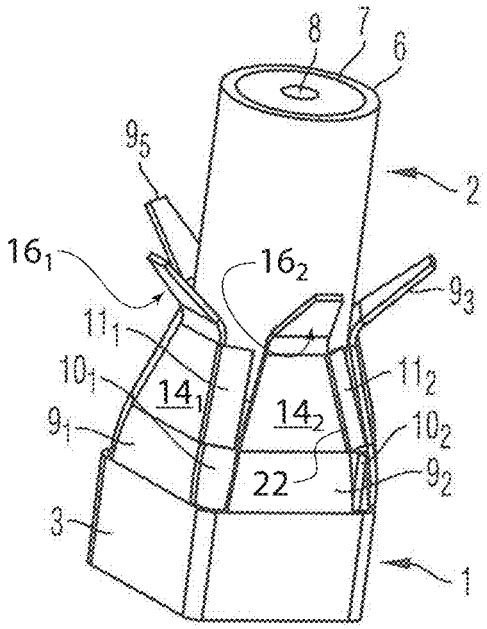
FIGS. 3A, 3B show an illustration of a side view and front view of a coaxial connector of a first sub-variant of a first embodiment of a coaxial connector according to the invention.
Figure 3B:
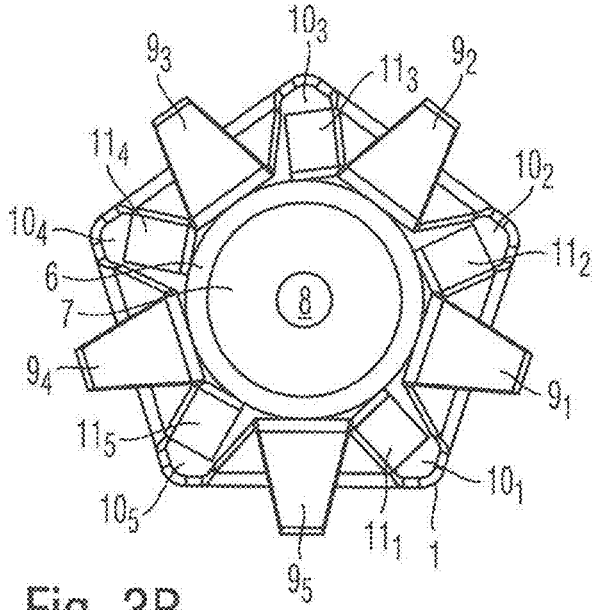

In a first sub-variant of the first embodiment according to the invention as per FIGS. 3A and 3B, the shielding component $11_1$, $11_2$, $11_3$, $11_4$ and $11_5$ is preferably of planar design. It has a size, shape, position and orientation with respect to the respective spring lug $9_1$, $9_2$, $9_3$, $9_4$ and $9_5$ to which it is fastened which permit optimum shielding of the respective gap $10_1$, $10_2$, $10_3$, $10_4$ and $10_5$. The size, shape, position and orientation of the shielding component $11_1$, $11_2$, $11_3$, $11_4$ and $11_5$ also prevent jamming or blocking with the respectively oppositely situated spring lug $9_1$, $9_2$, $9_3$, $9_4$ and $9_5$ in the non-plugged-together state of the coaxial connector portion and during the plugging-together of the first coaxial connector portion 1 with the second coaxial connector portion 2.

Figure 4A:
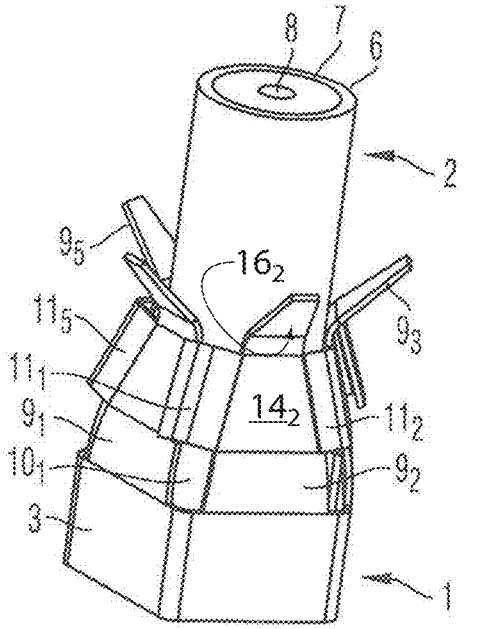
FIGS. 4A, 4B show an illustration of a side view and front view of a coaxial connector of a second sub-variant of a first embodiment of a coaxial connector according to the invention.
Figure 4B:
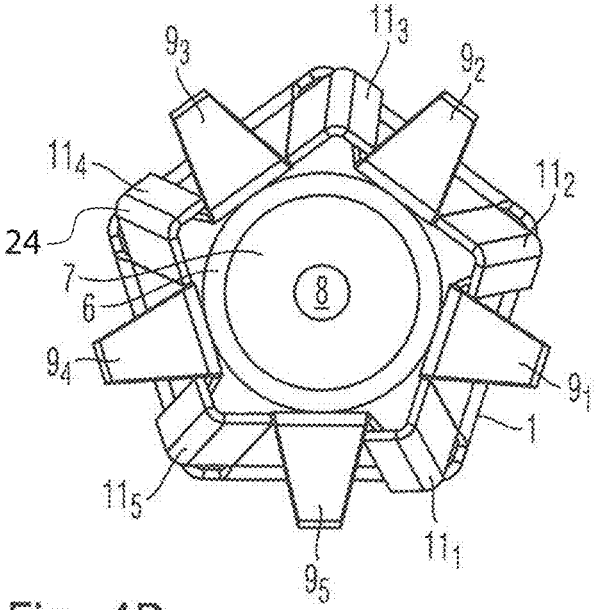

In a second sub-variant of the first embodiment according to the invention as per FIGS. 4A and 4B, the shielding component $11_1$, $11_2$, $11_3$, $11_4$ and $11_5$ has, approximately in the center of its width, in each case one bend which divides the individual shielding component $11_1$, $11_2$, $11_3$, $11_4$ and $11_5$ into two regions with respectively different orientation. The orientation of the two regions of each shielding component $11_1$, $11_2$, $11_3$, $11_4$ and $11_5$ corresponds approximately to the orientation of the respectively adjoining spring lug $9_1$, $9_2$, $9_3$, $9_4$ and $9_5$. Since the respectively adjacent spring lugs $9_1$, $9_2$, $9_3$, $9_4$ and $9_5$ have different orientations, a shielding component $11_1$, $11_2$, $11_3$, $11_4$ and $11_5$ with two regions whose orientation is approximated to the orientation of the adjoining spring lugs $9_1$, $9_2$, $9_3$, $9_4$ and $9_5$ realizes substantially optimum shielding of the interposed gap $10_1$, $10_2$, $10_3$, $10_4$ and $10_5$.

Figure 5A:
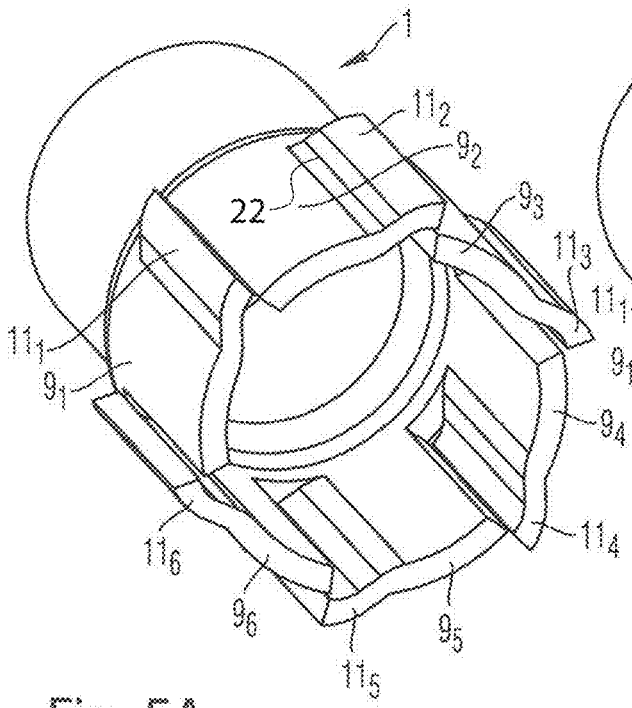
FIGS. 5A, 5B show an illustration of a side view of a coaxial connector of a third and a fourth sub-variant of a first embodiment of a coaxial connector according to the invention.

In a third sub-variant of the embodiment according to the invention, the individual shielding components $11_1$, $11_2$, $11_3$, $11_4$, $11_5$ and $11_6$ as per FIG. 5A each have a curvature which corresponds to the curvature of the individual spring lugs $9_1$, $9_2$, $9_3$, $9_4$, $9_5$ and $9_6$.

This third sub-variant of the first embodiment according to the invention is suitable in particular for a spring cage which has a hollow cylindrical main body. In the case of the third sub-variant of the first embodiment according to the invention, too, the gap is substantially optimally covered by the associated shielding component $11_1$, $11_2$, $11_3$, $11_4$, $11_5$ and $11_6$.

Figure 5B:
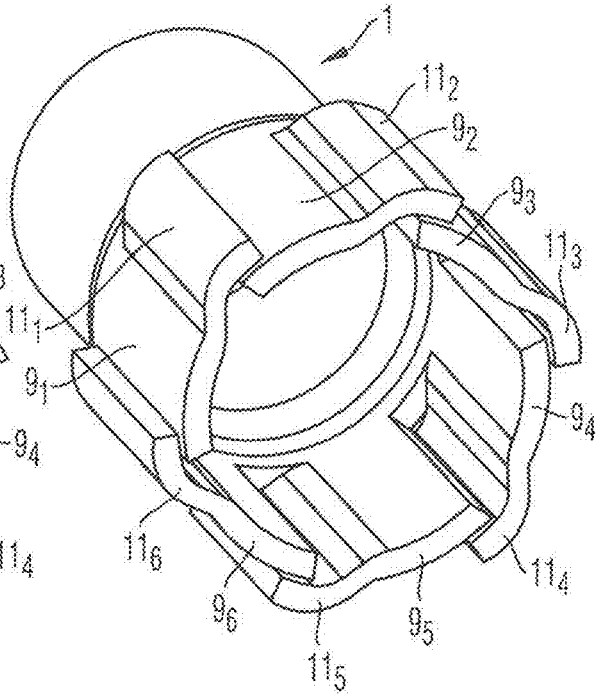

In an enhancement of the first embodiment according to the invention, the individual shielding components $11_1$, $11_2$, $11_3$, $11_4$, $11_5$ and $11_6$ cover not only the respective gap but also a sub-region of the oppositely situated spring lug $9_1$, $9_2$, $9_3$, $9_4$, $9_5$ and $9_6$. This is illustrated in in FIG. 5B for the case of a curved shielding component $11_1$, $11_2$, $11_3$, $11_4$, $11_5$ and $11_6$ as per the third sub-variant of the first embodiment according to the invention. A shielding component $11_1$, $11_2$, $11_3$, $11_4$, $11_5$ and $11_6$ which covers not only the associated gap but also the oppositely situated spring lug $9_1$, $9_2$, $9_3$, $9_4$, $9_5$ and $9_6$ is also conceivable for the first and second sub-variants of the first embodiment according to the invention, and is also encompassed by the invention.

In a second embodiment of the invention, in each case two shielding components $11_1$, $11_2$, $11_3$, $11_4$, $11_5$, $11_1'$, $11_2'$, $11_3'$, $11_4'$ and $11_5'$ are provided in each gap $10_1$, $10_2$, $10_3$, $10_4$ and $10_5$, which shielding components are respectively fastened to one of the two adjacent spring lugs $9_1$, $9_2$, $9_3$, $9_4$ and $9_5$. The two shielding components $11_1$, $11_2$, $11_3$, $11_4$, $11_5$, $11_1'$, $11_2'$, $11_3'$, $11_4'$ and $11_5'$ are in this case preferably fastened to the gap-side end of the respective spring lug $9_1$, $9_2$, $9_3$, $9_4$ and $9_5$. The doubling of the shielding components per gap improves the shielding of the respective gaps and thus reduces a radiation of the electromagnetic single energy out of the coaxial connector.

Figure 6A:
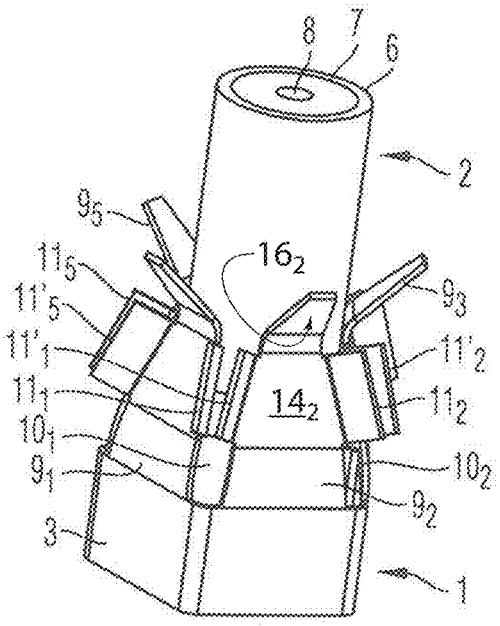
FIGS. 6A, 6B show an illustration of a side view and front view of a coaxial connector of a first sub-variant of a second embodiment of a coaxial connector according to the invention.
Figure 6B:
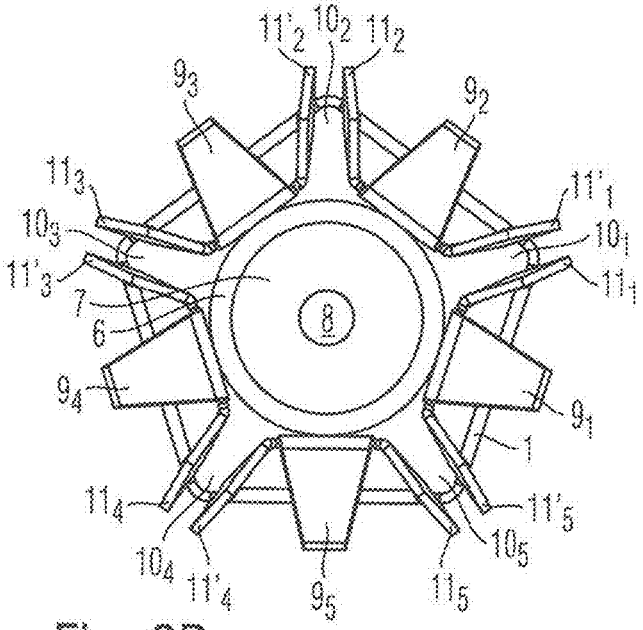

In a first sub-variant of the second embodiment according to the invention as per FIGS. 6A and 6B, the two shielding components $11_1$, $11_2$, $11_3$, $11_4$, $11_5$, $11_1'$, $11_2'$, $11_3'$, $11_4'$ and $11_5'$ of a gap $10_1$, $10_2$, $10_3$, $10_4$ and $10_5$ are fastened in each case to the gap-side ends of the respectively adjacent spring lugs $9_1$, $9_2$, $9_3$, $9_4$ and $9_5$, and are directed radially outward with respect to the longitudinal axis of the coaxial connector. In this way, between the two shielding components $11_1$, $11_2$, $11_3$, $11_4$, $11_5$, $11_1'$, $11_2'$, $11_3'$, $11_4'$ and $11_5'$ of a gap $10_1$, $10_2$, $10_3$, $10_4$ and $10_5$, there is formed in each case one channel in which electromagnetic radiation energy is attenuated between the two oppositely situated shielding components $11_1$, $11_2$, $11_3$, $11_4$, $11_5$, $11_1'$, $11_2'$, $11_3'$, $11_4'$ and $11_5'$. The electromagnetic radiation energy is thus considerably attenuated at the exit of a channel of said type.

Figure 7A:
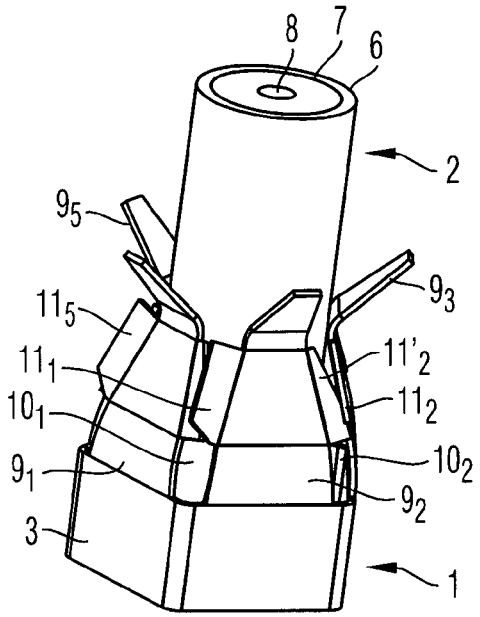
FIGS. 7A, 7B show an illustration of a side view and front view of a coaxial connector of a second sub-variant of a second embodiment of a coaxial connector according to the invention.
Figure 7B:
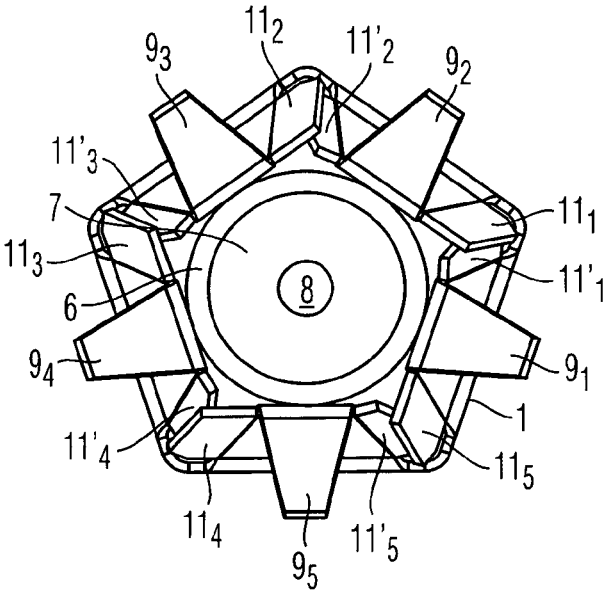

In a second sub-variant of the second embodiment according to the invention as per FIGS. 7A and 7B, the two shielding components $11_1$, $11_2$, $11_3$, $11_4$, $11_5$, $11_1'$, $11_2'$, $11_3'$, $11_4'$ and $11_5'$ of a gap $10_1$, $10_2$, $10_3$, $10_4$ and $10_5$ at least partially cover one another. The size, the shape, the position and the orientation of the two shielding components $11_1$, $11_2$, $11_3$, $11_4$, $11_5$, $11_1'$, $11_2'$, $11_3'$, $11_4'$ and $11_5'$ of a gap $10_1$, $10_2$, $10_3$, $10_4$ and $10_5$ are in this case selected such that the two shielding components $11_1$, $11_2$, $11_3$, $11_4$, $11_5$, $11_1'$, $11_2'$, $11_3'$, $11_4'$ and $11_5'$ of a gap $10_1$, $10_2$, $10_3$, $10_4$ and $10_5$ do not become seized, jammed or blocked relative to one another in the non-plugged-together state and in the plugged-together state of the coaxial connector and during the plugging-together of the first coaxial connector portion and of the second coaxial connector portion to form a coaxial connector. The size, the shape, the position and the orientation of the two shielding components $11_1$, $11_2$, $11_3$, $11_4$, $11_5$, $11_1'$, $11_2'$, $11_4'$ and $11_5'$ of a gap $10_1$, $10_2$, $10_3$, $10_4$ and $10_5$ should furthermore be configured such that the associated gap $10_1$, $10_2$, $10_3$, $10_4$ and $10_5$ is as far as possible optimally covered and thus shielded.

Figure 8A:
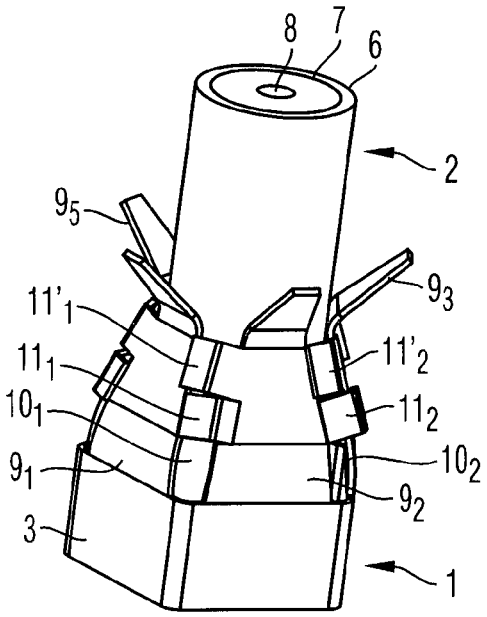
FIGS. 8A, 8B show an illustration of a side view and front view of a coaxial connector of a third sub-variant of a second embodiment of a coaxial connector according to the invention.
Figure 8B:
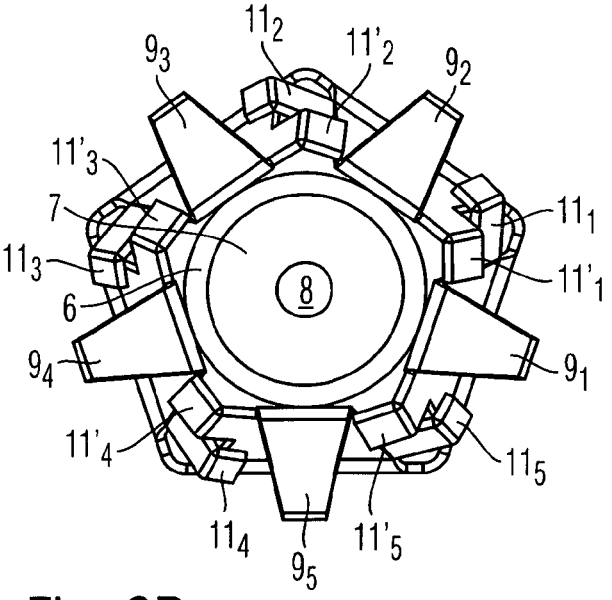

In a third sub-variant of the second embodiment according to the invention as per FIGS. 8A and 8B, the two shielding components $11_1$, $11_2$, $11_3$, $11_4$, $11_5$, $11_1'$, $11_2'$, $11_3'$, $11_4'$ and $11_5'$ of a gap $10_1$, $10_2$, $10_3$, $10_4$ and $10_5$ respectively cover a different section of the gap $10_1$, $10_2$, $10_3$, $10_4$ and $10_5$. The shape, size, the position and the orientation of the two shielding components $11_1$, $11_2$, $11_3$, $11_4$, $11_5$, $11_1'$, $11_2'$, $11_3'$, $11_4'$ and $11_5'$ of a gap $10_1$, $10_2$, $10_3$, $10_4$ and $10_5$ should in this case be configured such that, firstly, the respective gap $10_1$, $10_2$, $10_3$, $10_4$ and $10_5$ is as far as possible optimally covered by the two shielding components and thus shielded, and, secondly, no seizing, jamming or blocking of the two shielding components of a gap with respect to one another occurs in the plugged-together and non-plugged-together states of the coaxial connector and during the plugging-together of the first coaxial connector portion and of the second coaxial connector portion to form the coaxial connector.

Figure 9A:
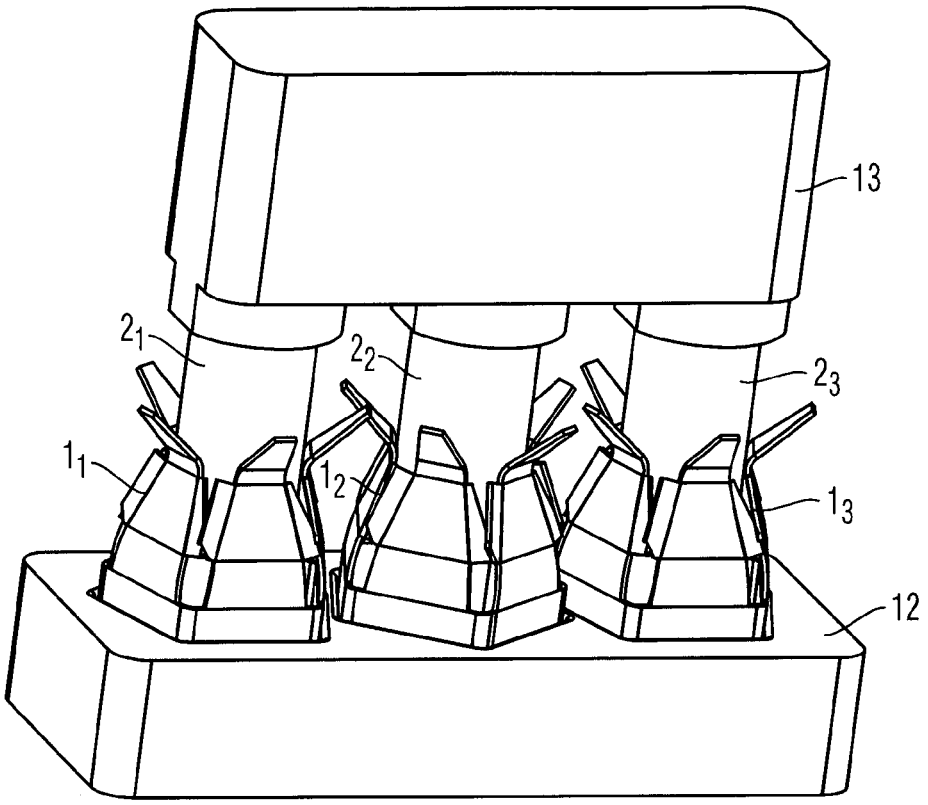
FIG. 9A shows a three-dimensional illustration of multiple coaxial connectors according to the invention.
Figure 9B:
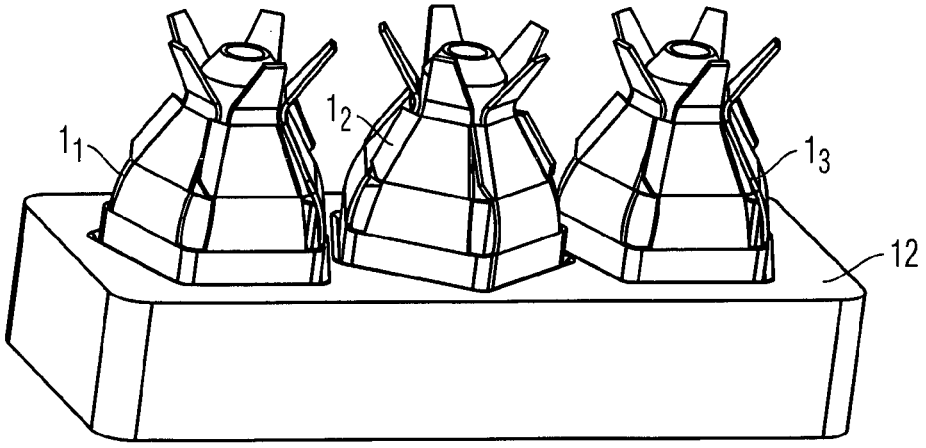
FIG. 9B shows a three-dimensional illustration of a multiple coaxial connector portion according to the invention.

FIG. 9B shows a multiple coaxial connector portion in the non-plugged-together state, in which three first coaxial connectors $1_1$, $1_2$ and $1_3$ are arranged and integrated in parallel in one housing 12. The invention also encompasses the integration of a different number of first coaxial connector portions in one housing 12. FIG. 9A shows multiple coaxial connector portions plugged together in parallel, in the case of which the first coaxial connector portions $1_1$, $1_2$ and $1_3$ are each arranged and integrated in one housing 12 and the associated second coaxial connector portions $\mathbf{2}_1$, $\mathbf{2}_2$ and $\mathbf{2}_3$ are each arranged and integrated in a further housing 13.

Figure 10:
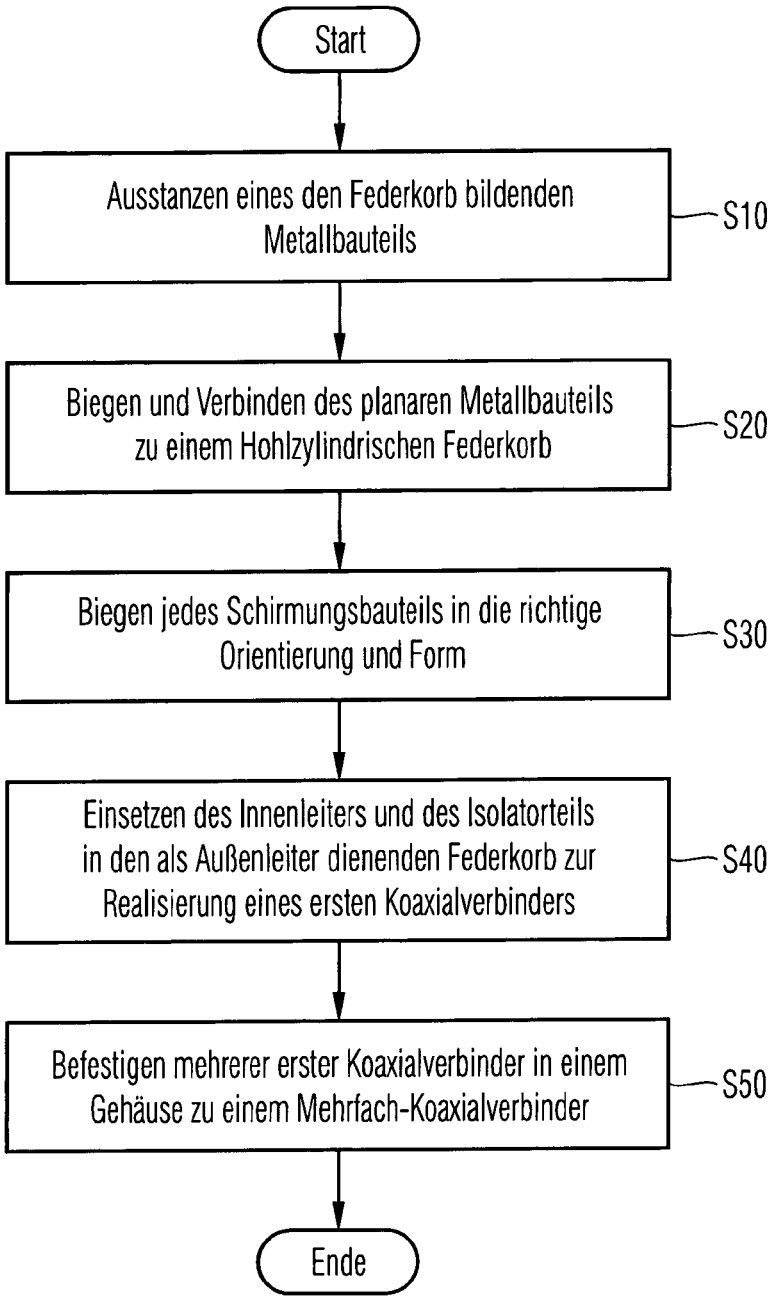
FIG. 10 shows a flow diagram of a method according to the invention for manufacturing a first coaxial connector portion according to the invention.

The manufacturing method for producing a first coaxial connector having a prismatic basic structure will be described below on the basis of the flow diagram in FIG. 10:

In the first method step S10, a planar component, which is intended to form the spring cage or the coaxial socket of the first coaxial connector portion, is punched in accordance with the axial length and the circumferential length of the spring cage or of the coaxial socket. For this purpose, a relatively large planar structural body composed of an electrically conductive material, preferably of a metal and particular preferably of a copper alloy, for example of spring bronze ($CuSn_6$), is used. During the punching process, the shielding components that are provided in each gap of the spring cage are in particular also punched out in accordance with their size, their position and their shape.

Here, it must be taken into consideration that the size, shape, number and arrangement of the individual shielding components in the individual gaps of the spring cage should be dimensioned and selected such that they can be punched out of the planar structural body in the region of the individual gaps of the spring cage that are formed.

In the next method step S20, the punched-out planar component is bent to form a prismatic spring cage and is connected together at the two shell-side ends of the component of prismatic shape.

In the subsequent method step S30, each shielding component in the individual gaps of the spring cage is bent and aligned with regard to its shape and its orientation with respect to the respective spring lug to which it is connected.

In the next method step S40, into the spring cage produced in the preceding method step S30, which spring cage serves as external conductor, there are fitted the associated insulator part and the associated internal conductor are fitted, and said insulator part and internal conductor are connected to one another to form a first coaxial connector portion according to the invention.

Optionally, in a final method step S50, multiple first coaxial connector portions produced in this way are fitted and fastened in a housing in order to produce a multiple coaxial connector portion.

The spring cage with a prismatic and sleeve-shaped basic structure may also, alternatively to the punching and bending process, be produced by means of cutting manufacturing methods. The attachment of the shielding components to the individual spring lugs of the spring cage is also conceivable by means of mechanical connecting techniques, for example by means of brazing or welding.

Figure 11:
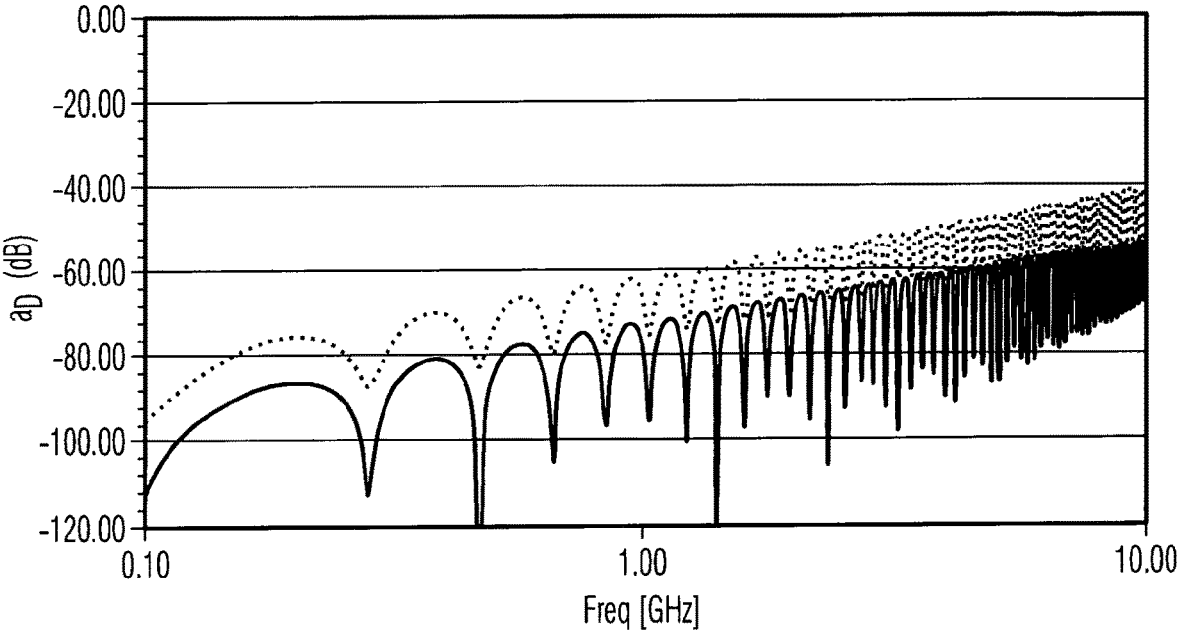
FIG. 11 shows a spectral illustration of the shield attenuation in a coaxial connector according to the invention.

FIG. 11 finally illustrates a spectral illustration, created by means of simulation, of the shielding attenuation $a_D$ for the case of a spring cage without shielding component in the individual gaps (dashed line) according to prior art and for the case of a spring cage according to the invention with at least one shielding component in the individual gaps (solid line).

It can be clearly seen that, over the entire frequency range considered, the shielding attenuation is much more pronounced in the case of a spring cage according to the invention with shielding components than in the case of a spring cage without shielding component according to the prior art.

The invention is not restricted to the illustrated embodiments, sub-variants and enhancements. The invention also encompasses in particular all combinations of the features respectively claimed in the individual patent claims, of the features respectively disclosed in the description, and of the features respectively illustrated in the figures of the drawing, where technically expedient.

The invention claimed is:

1. A connector, comprising:

an inner conductor; and an outer conductor coaxial to said inner conductor, a distal portion of said outer conductor comprising a plurality of tabs, wherein each of said tabs comprises a first portion and a shielding portion, said shielding portion extending substantially to a respective adjacent tab of said plurality of tabs, and for each of said tabs, said shielding portion of the respective tab projects in a generally circumferential direction from a lateral edge of said first portion of the respective tab.

2. The connector of claim 1, wherein:

each of said tabs comprises a second portion, a first plane defined by a major planar surface of said first portion intersecting a common axis of said inner conductor and said outer conductor at a first angle, and a second plane defined by a major planar surface of said second portion intersecting said common axis of said inner conductor and said outer conductor at a second angle significantly different from said first angle.

3. The connector of claim 1, wherein:

each of said tabs comprises a second portion, a first distance from a common axis of said inner conductor and said outer conductor to a proximal portion of said first portion being larger than a second distance from said common axis to a distal portion of said first portion, and a third distance from said common axis to a proximal portion of said second portion being smaller than a fourth distance from said common axis to a distal portion of said second portion.

4. The connector of claim 3, wherein:

said first portion consists of a substantially planar sheet of material, and said second portion consists of a substantially planar sheet of material.

5. The connector of claim 1, wherein:

said circumferential direction is a direction circumferential to a common axis of said inner conductor and said outer conductor.

6. The connector of claim 1, wherein:

for each of said tabs, said shielding portion of the respective tab does not contact another of said plurality of tabs.

7. The connector of claim 1, wherein:

each of said tabs comprises said first portion, said shielding portion and a bend selected from the group consisting of a first bend intermediate said first portion and said shielding portion and a second bend intermediate a first region of said shielding portion and a second region of said shielding portion.

8. The connector of claim 1, wherein:

said connector is a coaxial connector, and said distal portion of said outer conductor and a distal, terminal portion of said inner conductor collectively define a distal, terminal portion of said coaxial connector.

9. A connector, comprising:

an inner conductor; and an outer conductor coaxial to said inner conductor, a distal portion of said outer conductor comprising a plurality of tabs, each of said tabs comprising at least one laterally jutting shielding portion such that any ray emanating from a common axis of said inner conductor and said outer conductor in a plane perpendicular to said common axis intersects at least one of said plurality of tabs, and at least one of said tabs comprising a bend selected from the group consisting of a first bend substantially within the bounds of a respective one of said at least one laterally jutting shielding portion of the respective tab and a second bend along a border of a respective one of said at least one laterally jutting shielding portion of the respective tab.

10. The connector of claim 9, wherein:

each of said tabs comprises a first portion and a second portion, a first plane defined by a major planar surface of said first portion intersecting a common axis of said inner conductor and said outer conductor at a first angle, and a second plane defined by a major planar surface of said second portion intersecting said common axis of said inner conductor and said outer conductor at a second angle significantly different from said first angle.

11. The connector of claim 9, wherein:

each of said tabs comprises a first portion and a second portion, a first distance from a common axis of said inner conductor and said outer conductor to a proximal portion of said first portion being larger than a second distance from said common axis to a distal portion of said first portion, and a third distance from said common axis to a proximal portion of said second portion being smaller than a fourth distance from said common axis to a distal portion of said second portion.

12. The connector of claim 11, wherein:

for each of said tabs, said at least one laterally jutting shielding portion of the respective tab extends laterally from said first portion of the respective tab.

13. The connector of claim 11, wherein:

for each of said tabs, said at least one laterally jutting shielding portion of the respective tab extends in a generally circumferential direction from a lateral edge of said first portion of the respective tab.

14. The connector of claim 11, wherein:

said first portion consists of a substantially planar sheet of material, and said second portion consists of a substantially planar sheet of material.

15. The connector of claim 9, wherein:

for each of said tabs, each of said at least one laterally jutting shielding portion of the respective tab does not contact another of said plurality of tabs.

16. A connector, comprising:

an inner conductor; and an outer conductor coaxial to said inner conductor, a distal portion of said outer conductor comprising a plurality of tabs, each of said tabs comprising a first shielding portion that projects in a first substantially radial direction and a second shielding portion that projects in a second substantially radial direction.

17. The connector of claim 16, wherein:

for each of said tabs, said first shielding portion of the respective tab is substantially parallel to said second shielding portion of a first respectively adjacent tab and said second shielding portion of the respective tab is substantially parallel to said first shielding portion of a second respectively adjacent tab.

18. The connector of claim 16, wherein:

each of said tabs comprises a first portion and a second portion, a first plane defined by a major planar surface of said first portion intersecting a common axis of said inner conductor and said outer conductor at a first angle, and a second plane defined by a major planar surface of said second portion intersecting said common axis of said inner conductor and said outer conductor at a second angle significantly different from said first angle.

19. The connector of claim 16, wherein:

each of said tabs comprises a first portion and a second portion, a first distance from a common axis of said inner conductor and said outer conductor to a proximal portion of said first portion being larger than a second distance from said common axis to a distal portion of said first portion, and a third distance from said common axis to a proximal portion of said second portion being smaller than a fourth distance from said common axis to a distal portion of said second portion.

20. The connector of claim 19, wherein:

for each of said tabs, said first shielding portion projects from said first portion of the respective tab and said second shielding portion projects from said first portion of the respective tab.

21. The connector of claim 16, wherein:

each of said first substantially radial direction and said second substantially radial direction is substantially radial relative to a common axis of said inner conductor and said outer conductor.

22. A connector, comprising:

an inner conductor; and an outer conductor coaxial to said inner conductor, a distal portion of said outer conductor comprising a plurality of tabs, each of said tabs being bent to overlap a respective adjacent tab of said plurality of tabs without contacting said respective adjacent tab in a respective region of overlap.

23. A connector arrangement, comprising:

a first connector; and a second connector, wherein said first connector comprises a first inner conductor and a first outer conductor coaxial to said first inner conductor, said second connector comprises a second inner conductor and a second outer conductor coaxial to said second inner conductor, said first connector is connectable to said second connector such that said first inner conductor electrically contacts said second inner conductor and said first outer conductor electrically contacts said second outer conductor, a distal portion of said second outer conductor comprises a plurality of tabs, each of said tabs comprises a first portion and a shielding portion, said shielding portion extending substantially to a respective adjacent tab of said plurality of tabs, and for each of said tabs, said shielding portion of the respective tab projects in a generally circumferential direction from a lateral edge of said first portion of the respective tab.

24. An antenna system arrangement, comprising:

an antenna mounted on an exterior of an automobile; and a connector, wherein said conductor comprises an inner conductor and an outer conductor coaxial to said inner conductor, a distal portion of said outer conductor comprises a plurality of tabs, each of said tabs comprises a first portion and a shielding portion, said shielding portion extending substantially to a respective adjacent tab of said plurality of tabs, for each of said tabs, said shielding portion of the respective tab projects in a generally circumferential direction from a lateral edge of said first portion of the respective tab, and said antenna is electrically connected to said inner conductor.

* * * * *